US009918357B2

(12) United States Patent
Li et al.

(10) Patent No.: US 9,918,357 B2
(45) Date of Patent: Mar. 13, 2018

(54) FIXING MEMBER, COOKING RANGE AND OVEN WITH THE SAME

(71) Applicants: GUANGDONG MIDEA KITCHEN APPLIANCES MANUFACTURING CO., LTD., Beijiao (CN); MIDEA GROUP CO., LTD., Beijiao (CN)

(72) Inventors: Bingsheng Li, Beijiao (CN); Yonglin Ding, Beijiao (CN); Guoyong Guo, Beijiao (CN)

(73) Assignees: GUANGDONG MIDEA KITCHEN APPLIANCES MANUFACTURING CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 223 days.

(21) Appl. No.: 14/735,538

(22) Filed: Jun. 10, 2015

(65) Prior Publication Data

US 2015/0373785 A1 Dec. 24, 2015

(30) Foreign Application Priority Data

Jun. 19, 2014 (CN) ..... 2014 1 0276168
Jun. 19, 2014 (CN) ..... 2014 1 0276374
(Continued)

(51) Int. Cl.
*H05B 3/68* (2006.01)
*H05B 3/74* (2006.01)
(Continued)

(52) U.S. Cl.
CPC ..... *H05B 3/74* (2013.01); *F24C 7/067* (2013.01); *F24C 15/30* (2013.01)

(58) Field of Classification Search
CPC ..... F24C 15/30; F24C 15/108; F24C 15/34; F24C 15/36; F24C 15/02; F24C 7/06;
(Continued)

(56) References Cited

U.S. PATENT DOCUMENTS 4,012,578 A 3/1977 Moran et al.
4,235,406 A 11/1980 Vecchiarelli
(Continued)

FOREIGN PATENT DOCUMENTS

CN 101749769 6/2010
CN 102656946 9/2012
(Continued)

OTHER PUBLICATIONS

Amazon.com, Lexington Double Curtain Bracket Finish: Antique Brass, URL: https://www.amazon.com/Lexington-Double-Curtain-Bracket-Finish/dp/B008E4UVBW [retrieved on Jul. 7, 2017].
(Continued)

*Primary Examiner* — Shawntina Fuqua
(74) *Attorney, Agent, or Firm* — Hodgson Russ LLP

(57) ABSTRACT

A fixing member, a cooking range and an oven with the same are provided. The fixing member includes: a base plate defining a mounting hole; a connecting plate comprising a first plate segment connected at a first side of the base plate, a second plate segment, and a third plate segment substantially parallel to the base plate, the second plate segment being connected between the first and third plate segments; and a fixing plate defining a first end connected at a second side of the base plate and perpendicular to the base plate, and a second end having a snapping tongue bent and extended in a direction away from the connecting plate, a vertical distance between a free end of the snapping tongue and the base plate being equal to or smaller than that between the third plate segment and the base plate.

15 Claims, 6 Drawing Sheets

(30) Foreign Application Priority Data

| | | |
|---|---|---|
| Jun. 19, 2014 | (CN) ..... | 2014 2 0329526 U |
| Jun. 19, 2014 | (CN) ..... | 2014 2 0330759 U |
| Sep. 12, 2014 | (WO) ..... | PCT/CN2014/086408 |
| Sep. 12, 2014 | (WO) ..... | PCT/CN2014/086415 |

(51) Int. Cl.
*F24C 7/06* (2006.01)
*F24C 15/30* (2006.01)

(58) Field of Classification Search
CPC ..... F24C 7/062; F24C 7/067; F16B 2/241; F16B 2/20; F16B 2/205; F16B 2/24; F16B 2/246; H05B 3/748; H05B 3/74; H05B 3/742; H05B 3/744; H05B 3/76; H05B 3/06; H05B 2203/022; Y10T 24/44744; Y10T 24/44769; Y10T 24/44778; Y10T 24/44786; Y10T 24/44923; Y10T 24/45183
See application file for complete search history.

(56) References Cited

U.S. PATENT DOCUMENTS

| | | | | |
|---|---|---|---|---|
| 5,106,586 | A * | 4/1992 | Muszak | G01N 35/00029 267/158 |
| 5,399,839 | A | 3/1995 | Taplan et al. | |
| 6,341,754 | B1 | 1/2002 | Melito et al. | |
| 2010/0089640 | A1 | 4/2010 | DiLillo et al. | |

FOREIGN PATENT DOCUMENTS

| | | |
|---|---|---|
| CN | 203413690 | 1/2014 |
| CN | 203493460 | 3/2014 |
| CN | 203953380 | 11/2014 |
| DE | 3037965 | 4/1982 |
| DE | 8229638 | 12/1982 |
| DE | 19835971 | 2/2000 |
| DE | 102006026909 | 12/2007 |
| DE | 102011056304 | 6/2013 |
| KR | 20060014789 | 2/2006 |
| WO | 9841059 | 9/1998 |
| WO | 2007133003 | 11/2007 |
| WO | 2009083389 | 7/2009 |
| WO | 2011077332 | 6/2011 |
| WO | 2012062881 | 5/2012 |

OTHER PUBLICATIONS

Doughty Engineering Ltd., Double Ended: Hook Clamp Double Ended 180 Twist, URL: http://www.doughty-engineering.co.uk/cgi-bin/trolleyed_public.cgi?action=showprod_T19700 [retrieved on Jul. 7, 2017].

* cited by examiner

FIXING MEMBER, COOKING RANGE AND OVEN WITH THE SAME

FIELD

The present invention relates to a technical field of kitchenware, and more particularly to a fixing member, a cooking range with the fixing member, and an oven with the cooking range.

BACKGROUND

In a cooking range of a current oven, a fixing member for a heating unit has the following defects: large volume, complicated assembling and in a great quantity (three or more).

Moreover, the procedures for assembling the cooking range of the oven in the prior art are usually presented as follows. 1. A group of assembling brackets is welded around an inner frame of a cooking range plate; 2. A glass panel is imbedded into the inner frame of the cooking range plate, and fixed all round by a glue; 3. An installation fixing plate is mounted at an inner surface of the glass panel; 4. Each heating unit corresponds to four Z-shape snapping buckles respectively, and is fixed on the installation fixing plate by a bolt; 5. An indicating lamp holder is fixed on the installation fixing plate by a plurality of bolts. This assembling method is material-consuming, and complicated in assembling and maintaining along with many procedures, which affects the cost and quality of the oven seriously.

SUMMARY

The present invention seeks to solve at least one of the problems existing in the prior art to at least some extent. Therefore, an objective of the present invention is to provide a fixing member with simple structure and convenient assembly.

Another objective of the present invention is to provide a cooking range with the above fixing member.

Another objective of the present invention is to provide an oven with the above cooking range.

According to a first aspect of embodiments of the present invention, a fixing member includes: a base plate defining a mounting hole; a connecting plate comprising a first plate segment connected at a first side of the base plate, a second plate segment, and a third plate segment substantially parallel to the base plate, the second plate segment being connected between the first and third plate segments; and a fixing plate defining a first end connected at a second side of the base plate and perpendicular to the base plate, and a second end having a snapping tongue bent and extended in a direction away from the connecting plate. A vertical distance between a free end of the snapping tongue and the base plate is equal to or smaller than that between the third plate segment and the base plate.

The fixing member according to the embodiments of the present invention is convenient for assembling with a simple structure, and can fix the brackets in the cooking range of the oven stably.

In some embodiments, the second plate segment is configured as a sloping plate slantwise extended from the base plate to the third plate segment upwardly.

In some embodiments, the first plate segment is configured as a flat plate perpendicular to the base plate.

In some embodiments, the first plate segment is configured as an arc plate protruded in a direction away from the fixing plate.

In some embodiments, at least one of the first plate segment and the second plate segment is formed with a through-hole.

In some embodiments, a notch is formed at a free end of the third plate segment at a position corresponding to the snapping tongue.

In some embodiments, the fixing plate has a recess extended from an upper end of the fixing plate towards a lower end of the fixing plate, and an extension plate extended in a direction away from the base plate, in which the snapping tongue is disposed at a free end portion of the extension plate.

In some embodiments, the base plate, the connecting plate and the fixing plate are integrally formed via a stamping process.

According to a second aspect of embodiments of the present invention, a cooking range includes: an annular plate defining an aperture therein and having an annular platform formed at an inner wall of the aperture; a panel fitted within the aperture and supported by the annular platform; a bracket detachably connected with the annular plate and located below the panel; a heating unit disposed between the panel and the bracket, and detachably mounted on the bracket via a fixing member according to the above embodiments; and an indicating lamp holder detachably mounted on the annular plate.

The cooking range according to the embodiments of the present invention is convenient for assembling and disassembling with a simple structure, and has high efficiency and low cost.

In some embodiments, the fixing member is mounted on the heating unit by a bolt; the bracket has a snapping groove adapted to the snapping tongue. An upper surface of the third plate segment abuts against a lower surface of the bracket, and the snapping tongue passes through the snapping groove so as to abut against an upper surface of the bracket, such that the fixing member clamps the bracket.

In some embodiments, the bracket includes a first bracket and a second bracket parallel to each other and extended in a front-and-rear direction.

In some embodiments, a front mounting plate is connected with a front side wall of the aperture, is located below the annular platform, and has a first mounting portion, a second mounting portion and an inserting part between the first mounting portion and the second mounting portion, in which the indicating lamp holder is disposed in the inserting part. A rear mounting plate is connected with a rear side wall of the aperture, is located below the annular bearing platform, and has a third mounting portion corresponding to the first mounting portion and a fourth mounting portion corresponding to the second mounting portion. First and second ends of the first bracket are detachably connected to the first mounting portion and the third mounting portion respectively; first and second ends of the second bracket are detachably connected to the second mounting portion and the fourth mounting portion respectively.

In some embodiments, the annular plate is integrally formed by a stamping process.

In some embodiments, an adhesive layer is disposed between the panel and the annular platform.

According to a third aspect of embodiments of the present invention, an oven includes the cooking range according to the above embodiments.

Additional aspects and advantages of embodiments of present invention will be given in part in the following descriptions, become apparent in part from the following descriptions, or be learned from the practice of the embodiments of the present invention.

BRIEF DESCRIPTION OF THE DRAWINGS

These and other aspects and advantages of the present invention will become apparent and more readily appreciated from the following descriptions made with reference to the drawings, in which.

REFERENCE NUMERALS

Figure 1:
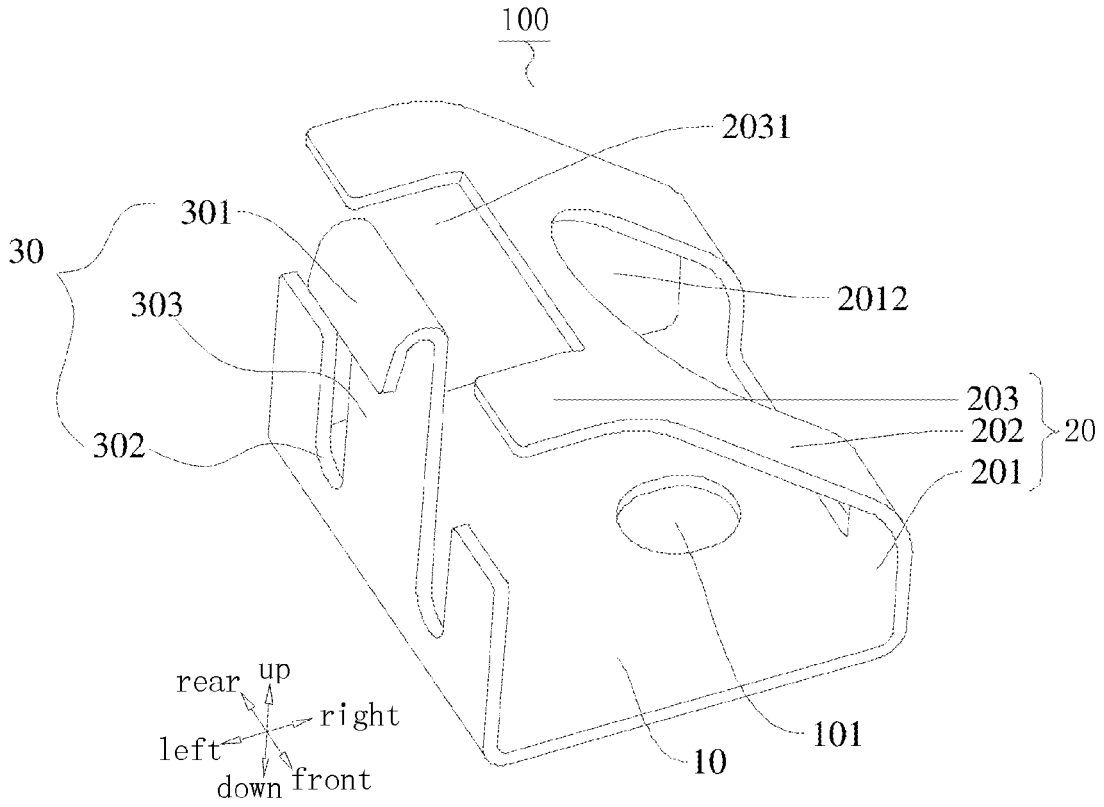
FIG. 1 is a schematic view of a fixing member according to an embodiment of the present invention.

100 fixing member
10 base plate
101 mounting hole
20 connecting plate
201 first plate segment
202 second plate segment
203 third plate segment
30 fixing plate
301 snapping tongue
302 recess
303 extension plate
200 annular plate
210 aperture
211 annular platform
220 front mounting plate
221 first mounting portion
221 second mounting portion
223 inserting part
230 rear mounting plate
231 third mounting portion
232 fourth mounting portion
300 panel
400 bracket
410 snapping groove
421 first bracket
422 second bracket
500 heating unit
600 indicating lamp holder
700 bolt

DETAILED DESCRIPTION

Embodiments of the present invention will be described in detail and examples of the embodiments will be illustrated in the drawings, where same or similar reference numerals are used to indicate same or similar members or members with same or similar functions. The embodiments described herein with reference to drawings are explanatory, which are used to illustrate the present invention, but shall not be construed to limit the present invention.

In the description of the present invention, it is to be understood that terms such as "central," "upper," "lower," "front," "rear," "left," "right," "vertical," "horizontal," "top," "bottom," "inner" and "outer" should be construed to refer to the orientation or position as shown in the drawings under discussion. These relative terms are for convenience of description and do not indicate or imply that the apparatus or members must have a particular orientation or be constructed and operated in a particular orientation. Therefore, these terms shall not be construed to limit the present invention.

In addition, terms such as "first" and "second" are used herein for purposes of description and are not intended to indicate or imply relative importance or significance or to imply the number of indicated technical features. Thus, the feature defined with "first" and "second" may explicitly or implicitly include one or more of this feature. In the description of the present invention, "a plurality of" means two or more than two, unless specified otherwise.

In the present invention, unless specified or limited otherwise, the terms "mounted," "connected," "coupled" and the like are used broadly, and may be, for example, fixed connections, detachable connections, or integral connections; may also be direct connections or indirect connections via intervening structures, which can be understood by those skilled in the art according to specific situations.

In the following, a fixing member according to the embodiments of the present invention will be described with reference to FIG. 1 to FIG. 2.

Figure 2:
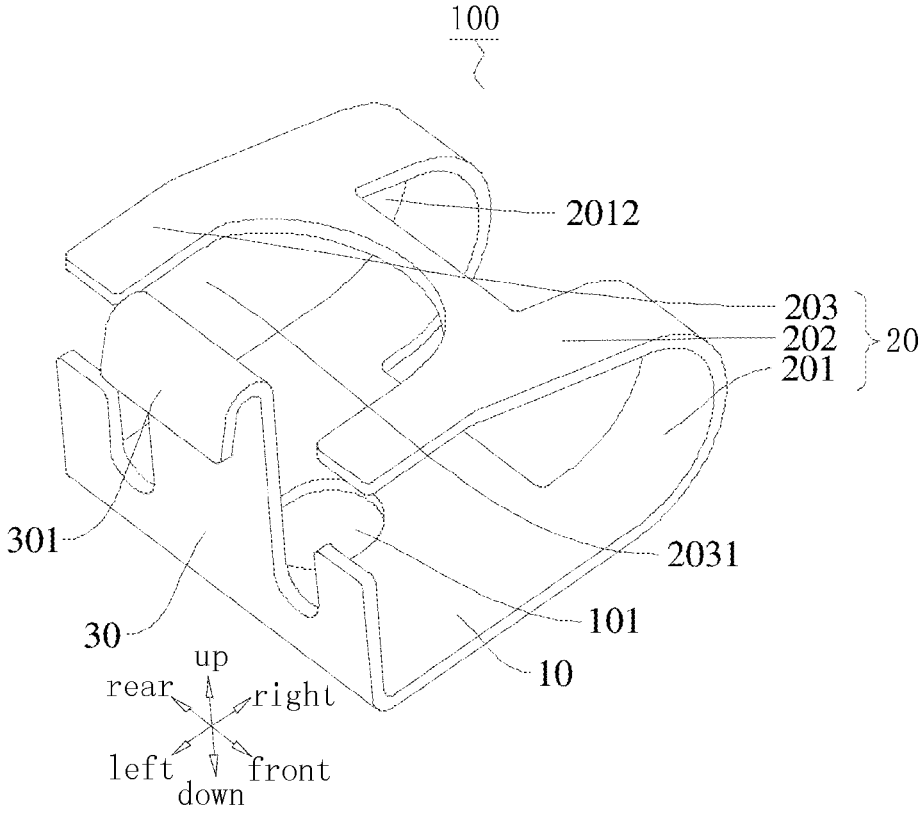
FIG. 2 is a schematic view of a fixing member according to another embodiment of the present invention.

As shown in FIG. 1 and FIG. 2, the fixing member 100 according to the embodiments of the present invention includes a base plate 10, a connecting plate 20 and a fixing plate 30. The base plate 10 defines a mounting hole 101. Advantageously, the mounting hole 101 may be an oblong hole, which can eliminate assembling errors.

The connecting plate includes a first plate segment 201 connected at a first side of the base plate 10, a second plate segment 202, and a third plate segment 203 substantially parallel to the base plate 10, the second plate segment 202 being connected between the first and third plate segments. The fixing plate 30 defines a first end connected at a second side of the base plate 10 and perpendicular to the base plate 10, and a second end having a snapping tongue 301 bent and extended in a direction away from the connecting plate 20. A vertical distance between a free end of the snapping tongue 301 and the base plate 10 is equal to or smaller than that between the third plate segment 203 and the base plate 10.

In the following description on the fixing member, for the convenience of description, the base plate 10 is supposed at a horizontal plane, and the third plate segment 203 extends in a horizontal direction, such that the extension direction of each component is presented in FIG. 1 and FIG. 2. In other words, as shown in FIG. 1 and FIG. 2, a lower edge of the connecting plate is connected with a right edge of the base plate 10. More specifically, a lower edge of the first plate segment 201 is connected with the right edge of the base plate 10. A lower edge of the second plate segment 202 is connected with an upper edge of the first plate segment 201. A right edge of the third plate segment 203 is connected with an upper edge of the second plate segment 202. The first plate segment 201 and the second plate segment 202 both provide an upward elastic force for the third plate segment 203.

A lower edge of the fixing plate 30 is connected with a left edge of the base plate 10, and an upper edge of the fixing plate 30 defines a snapping tongue 301. A horizontal position of a lower edge of the snapping tongue 301 is equal to or lower than an upper surface of the third plate segment 203.

Figure 7:
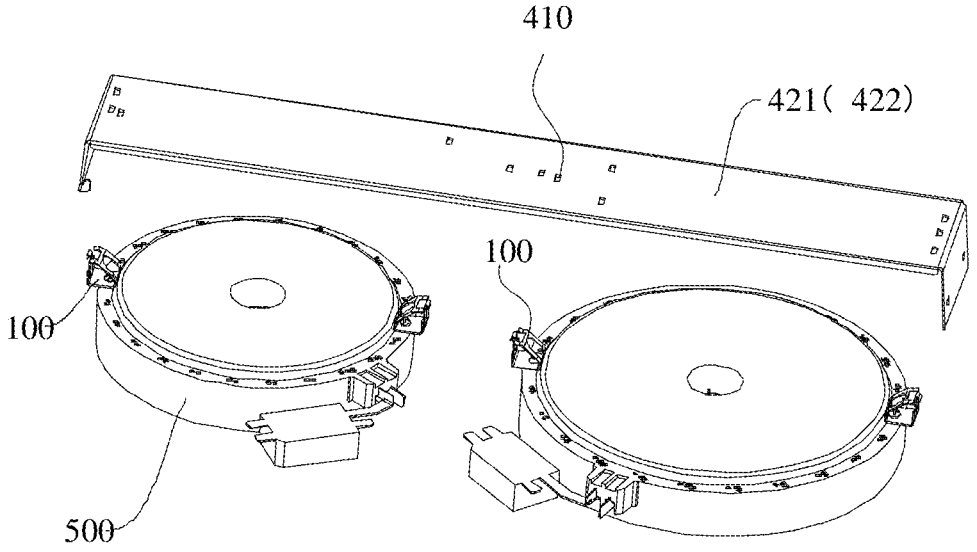
FIG. 7 is a schematic view of assembling the heating module with a bracket by the fixing member shown in FIG. 6.
Figure 8:
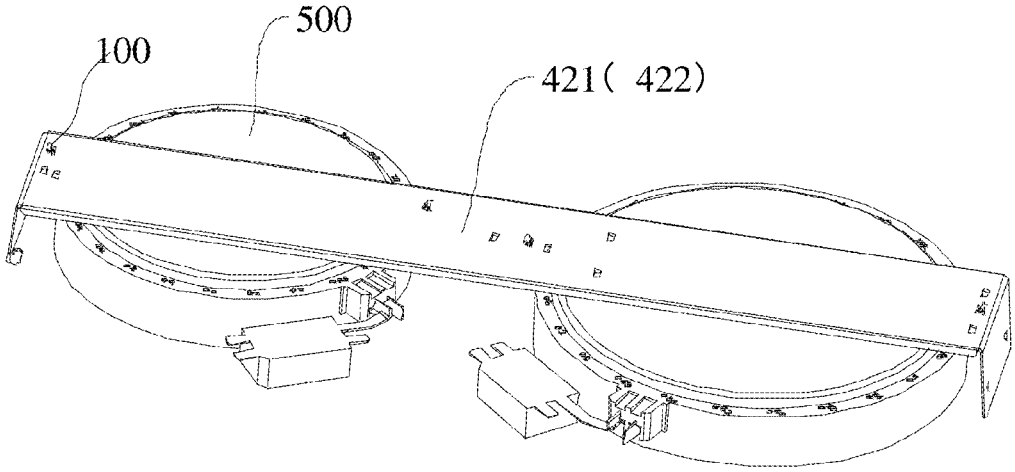
FIG. 8 is a schematic view of the heating module and the bracket assembled according to FIG. 7.
Figure 9:
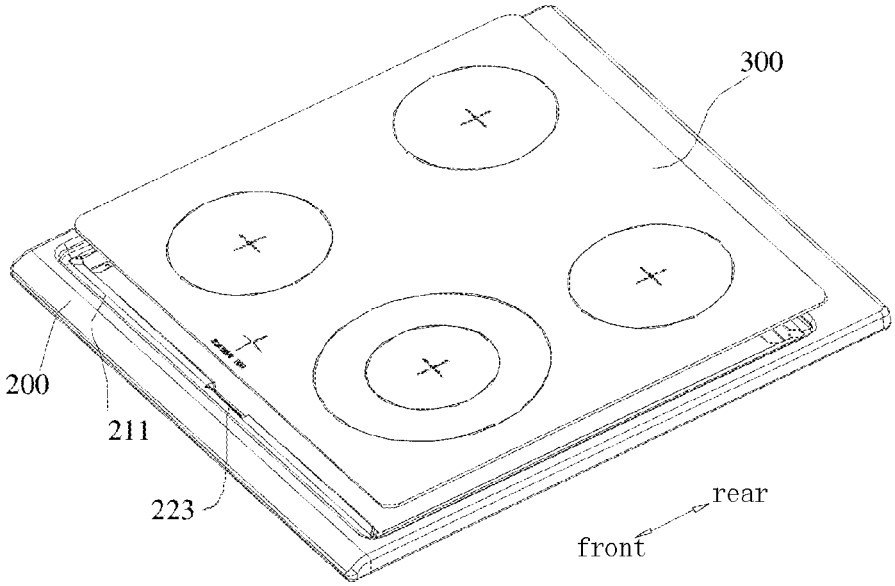
FIG. 9 is a top exploded view of the cooking range shown in FIG. 3.
Figure 10:
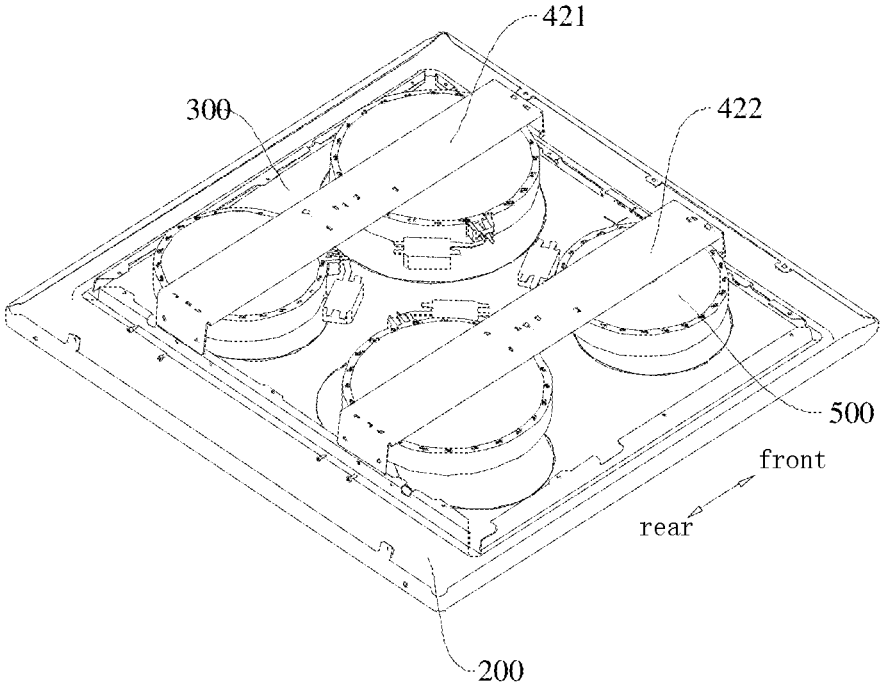
FIG. 10 is a bottom schematic view of a cooking range according to another embodiment of the present invention.

Consequently, when the fixing member 100 needs to fix a bracket 400, as shown in FIG. 7 and FIG. 8, the bracket 400 has a snapping groove 410 adapted to the snapping tongue 301. The upper surface of the third plate segment 203 abuts against a lower surface of the bracket 400, and the snapping tongue 301 passes through the snapping groove 410, such that the lower edge of the snapping tongue 301 abuts against an upper surface of the bracket 400. Since the horizontal position of the lower edge of the snapping tongue 301 is equal to or lower than the upper surface of the third plate segment 203, the third plate segment 203 is pressed downwards by the bracket 400, and hence bounces the bracket 400 upwards, but the lower edge of the snapping tongue 301 abuts against the upper surface of the bracket 400, such that the fixing member 100 clamps the bracket 400 elastically.

The fixing member according to the embodiments of the present invention is convenient for assembling with a simple structure, and can fix the brackets in the cooking range of the oven stably.

According to some embodiments of the present invention, the second plate segment 202 is configured as a sloping plate slantwise extended from the base plate 10 to the third plate segment 203 upwardly, as shown in FIG. 1 and FIG. 2.

In some alternative embodiments, the first plate segment 201 is configured as a flat plate perpendicular to the base plate 10. In an example shown in FIG. 1, the first plate segment 201 is configured as a flat plate vertically extends upwards. In some other alternative embodiments, as shown in FIG. 2, the first plate segment 201 is configured as an arc plate protruded in a direction away from the fixing plate 30, such that the fixing member 100 is in a good elasticity.

In order to save the material and lower the cost, at least one of the first plate segment 201 and the second plate segment 202 is formed with a through-hole 2012. That's to say, the through-hole 2012 can be formed in the first plate segment 201 alone, or in the second plate segment 202 alone, or in both the first plate segment 201 and the second plate segment 202, as shown in FIG. 1 and FIG. 2. In a further embodiment, as shown in FIG. 1, a notch 2031 is formed at a free end of the third plate segment 203 at a position corresponding to the snapping tongue 301.

As shown in FIG. 1 and FIG. 2, the fixing plate 30 has a recess 302 extended from an upper end of the fixing plate 30 towards a lower end of the fixing plate 30, and an extension plate 303 extended in a direction away from the base plate 10, in which the snapping tongue 301 is disposed at a free end portion of the extension plate 303, i.e. an upper end portion in FIG. 1 and FIG. 2. Thus, the fixing plate 30 cannot only clamp the bracket 400, but also support the bracket 400.

Alternatively, the base plate 10, the connecting plate 20 and the fixing plate 30 are integrally formed. For example, the base plate 10, the connecting plate 20 and the fixing plate 30 are integrally formed via a stamping process.

In the following, a cooking range according to the embodiments of the present invention will be described with reference to FIG. 3 to FIG. 10.

Figure 3:
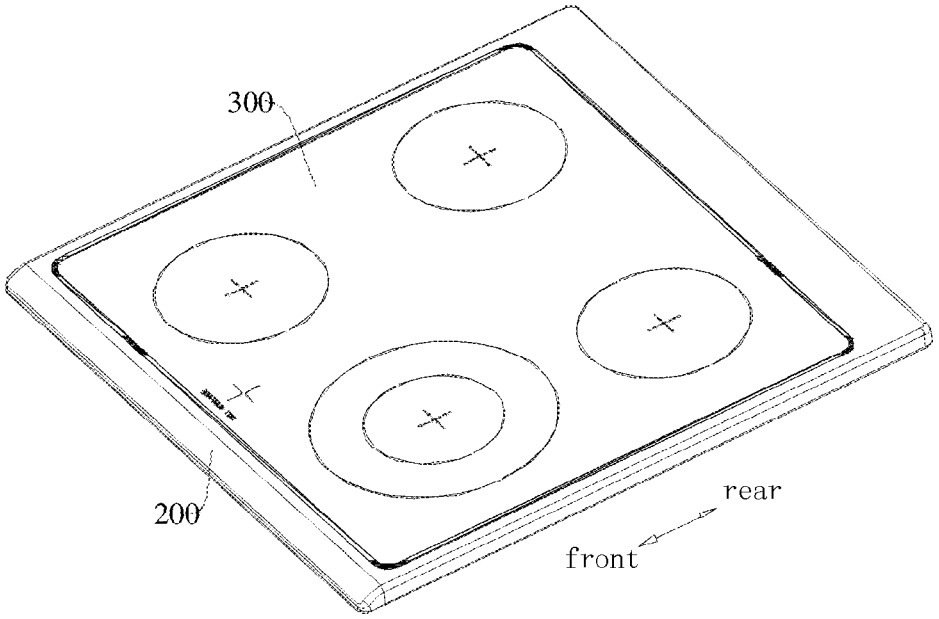
FIG. 3 is a top schematic view of a cooking range according to an embodiment of the present invention.
Figure 4:
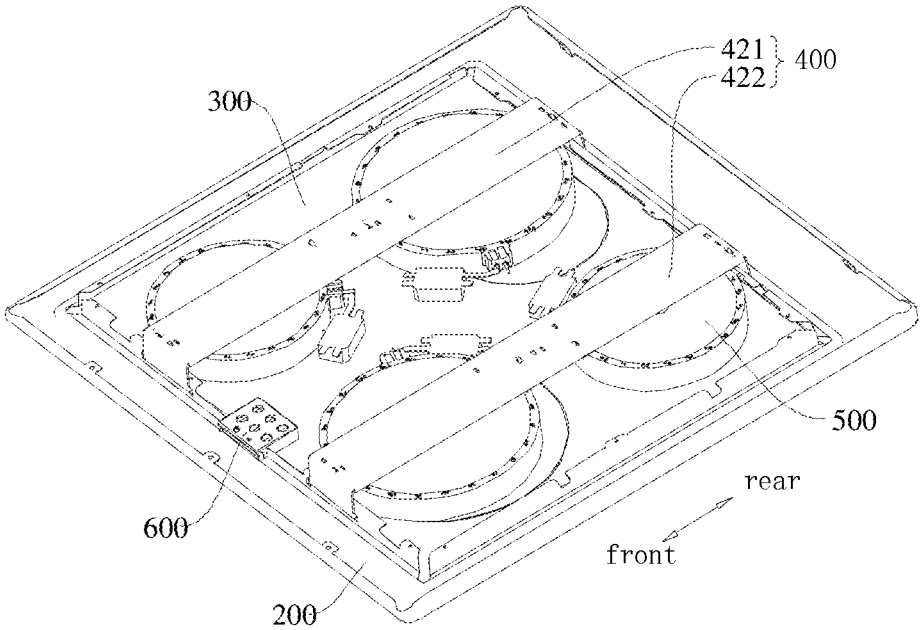
FIG. 4 is a bottom schematic view of the cooking range shown in FIG. 3.
Figure 5:
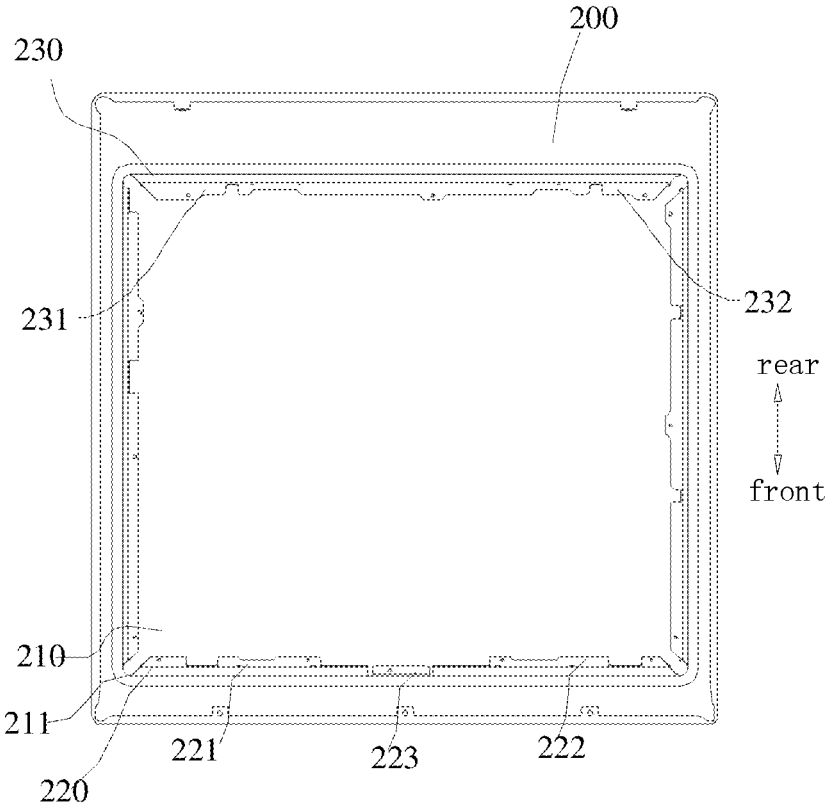
FIG. 5 is a schematic view of an annular plate of the cooking range shown in FIG. 4.

As shown in FIG. 3 and FIG. 4, the cooking range according to the embodiments of the present invention includes an annular plate 200, a panel 300, a bracket 400, a heating unit 500 and an indicating lamp holder 600. The annular plate 200 defines an aperture 210 therein and has an annular platform 211 formed at an inner wall of the aperture 210, as shown in FIG. 5. Alternatively, the annular plate 200 is integrally formed by a stamping process. The indicating lamp holder 600 is detachably mounted on the annular plate 200.

The panel 300 is fitted within the aperture 210 and supported by the annular platform 211. For example, the panel 300 can be imbedded in the aperture 210 and supported by the annular platform 211, as shown in FIG. 3 and FIG. 8. Advantageously, an adhesive layer is disposed between the panel 300 and the annular platform 211, to connect the panel 300 with the annular plate 200 firmly.

The bracket 400 is detachably connected with the annular plate 200 and located below the panel 300. For example, the bracket 400 may be snap-fitted or screw-connected with the annular plate. The heating unit 500 is disposed between the panel 300 and the bracket 400, and is detachably mounted on the bracket 400 via the fixing member according to the above embodiments.

The cooking range according to the embodiments of the present invention is convenient for assembling and disassembling with a simple structure, and has high efficiency and low cost.

Figure 6:
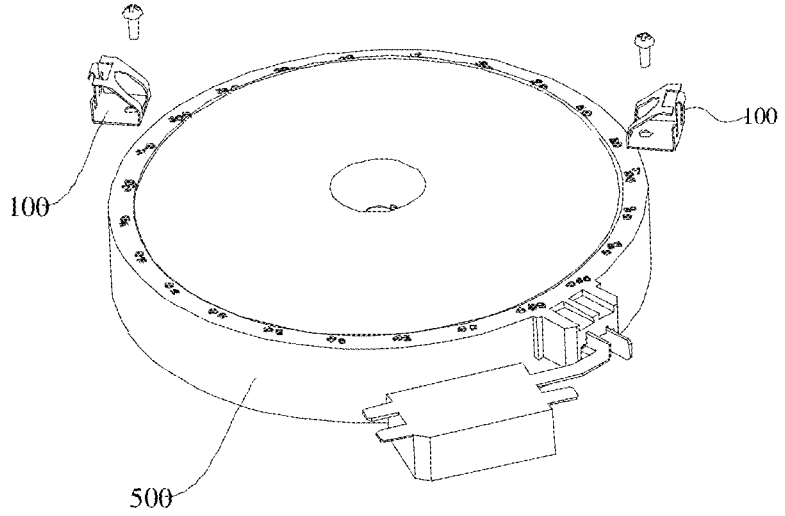
FIG. 6 is a schematic view of assembling a heating module with a fixing member by a bolt in the cooking range shown in FIG. 4.

According to an embodiment of the present invention, the fixing member 100 is mounted on the heating unit 500 via a bolt 700, as shown in FIG. 6. The bracket 400 has the snapping groove 410 adapted to the snapping tongue 301. The upper surface of the third plate segment 203 abuts against the lower surface of the bracket 400, and the snapping tongue 301 passes through the snapping groove 410, such that the lower edge of the snapping tongue 301 abuts against the upper surface of the bracket 400. In other words, the bolt 700 passes through the mounting hole 101 of the fixing member 100, so as to fix the fixing member 100 on the heating unit 500. Preferably, there are two fixing members 100 arranged symmetrically on the heating unit 500, as shown in FIG. 7 and FIG. 8. The snapping tongue 301 passes through the snapping groove 410, and the lower edge of the snapping tongue 301 abuts against the upper surface of the bracket 400.

Since the horizontal position of the lower edge of the snapping tongue 301 is equal to or lower than the upper surface of the third plate segment 203, the third plate segment 203 is pressed downwards by the bracket 400, and hence bounces the bracket 400 upwards, but the lower edge of the snapping tongue 301 abuts against the upper surface of the bracket 400, such that the fixing member 100 clamps the bracket 400 elastically. Thus, the bracket 400 and the heating unit 500 are connected via the fixing member 100.

As shown in FIG. 7 and FIG. 8, the bracket 400 includes a first bracket 421 and a second bracket 422 parallel to each other and extended in a front-and-rear direction.

As shown in FIG. 5, a front mounting plate 220 is connected with a front side wall of the aperture 210, is located below the annular platform 211, and has a first mounting portion 221, a second mounting portion 222 and an inserting part 223 between the first mounting portion 221 and the second mounting portion 222. The inserting part 223 is configured to mount the indicating lamp holder 600, as shown in FIG. 4.

Correspondingly, a rear mounting plate 230 is connected with a rear side wall of the aperture 210, is located below the annular bearing platform 211, and has a third mounting portion 231 corresponding to the first mounting portion 221 and a fourth mounting portion 232 corresponding to the second mounting portion 222.

Thus, as shown in FIG. 4, first and second ends of the first bracket 421 are detachably connected to the first mounting portion 221 and the third mounting portion 231 respectively; first and second ends of the second bracket 422 are detachably connected to the second mounting portion 222 and the fourth mounting portion 232 respectively. Specifically, the front end of the first bracket 421 is detachably connected with the first mounting portion 221, and the rear end thereof is detachably connected with the third mounting portion 231. The front end of the second bracket 422 is detachably connected with the second mounting portion 222, and the rear end thereof is detachably connected with the fourth mounting portion 232. The detachable connection herein refers to snap joint, screw connection or the like.

In the cooking range according to the embodiments of the present invention, the annular plate can be directly molded, in avoidance of a subsequent welding process, which results in high production conformity and efficiency. The installation fixing plate is seldom used, which saves the materials and lowers the cost. The use of the bolts is decreased, so as to improve the production efficiency. The assembling process is modularized, including preassembled modules of the annular plate and the panel, for example, and preassembled modules of the heating unit, the elastic fixing member and the bracket, which reduce the final assembling procedures, and hence improves the production efficiency. The assembling and disassembling are convenient, so as to facilitate the maintenance of the heating unit.

The present invention further provides an oven with the above cooking range according to the above embodiments. Other components of the oven and the operation thereof are known to those skilled in the art, which will not be illustrated in detail.

Reference throughout this specification to "an embodiment," "some embodiments," "exemplary embodiments," "examples," "specific examples," or "some examples" means that a particular feature, structure, material, or characteristic described in connection with the embodiment or example is included in at least one embodiment or example of the present invention. Thus, these terms throughout this specification do not necessarily refer to the same embodiment or example of the present invention. Furthermore, the particular features, structures, materials, or characteristics may be combined in any suitable manner in one or more embodiments or examples. In addition, those skilled in the art can combine different embodiments or examples described in the specification.

Although embodiments of the present invention have been shown and described, it would be appreciated by those skilled in the art that changes, modifications, alternatives and variations can be made in the embodiments without departing from spirit and principles of the present invention.

What is claimed is:

1. A fixing member, comprising:

a base plate defining a mounting hole;

a connecting plate comprising a first plate segment connected at a first side of the base plate, a second plate segment, and a third plate segment substantially parallel to the base plate, the second plate segment being connected between the first and third plate segments; and a fixing plate defining a first end connected at a second side of the base plate and perpendicular to the base plate, and a second end having a snapping tongue bent and extended in a direction away from the connecting plate, a vertical distance between a free end of the snapping tongue and the base plate being equal to or smaller than that between the third plate segment and the base plate;

wherein a notch is formed at a free end of the third plate segment at a position corresponding to the snapping tongue.

2. The fixing member according to claim 1, wherein the second plate segment is configured as a sloping plate slantwise extended from the base plate to the third plate segment upwardly.

3. The fixing member according to claim 1, wherein the first plate segment is configured as a flat plate perpendicular to the base plate.

4. The fixing member according to claim 1, wherein the first plate segment is configured as an arc plate protruded in a direction away from the fixing plate.

5. The fixing member according to claim 1, wherein at least one of the first plate segment and the second plate segment is formed with a through-hole.

6. The fixing member according to claim 1, wherein the fixing plate has a recess extended from an upper end of the fixing plate towards a lower end of the fixing plate, and an extension plate extended in a direction away from the base plate, wherein the snapping tongue is disposed at a free end portion of the extension plate.

7. The fixing member according to claim 1, wherein the base plate, the connecting plate and the fixing plate are integrally formed via a stamping process.

8. A cooking range, comprising:

an annular plate defining an aperture therein and having an annular platform formed at an inner wall of the aperture;

a panel fitted within the aperture and supported by the annular platform;

a bracket detachably connected with the annular plate and located below the panel;

a heating unit disposed between the panel and the bracket, and detachably mounted on the bracket via a fixing member, the fixing member comprising:

a base plate defining a mounting hole;

a connecting plate comprising a first plate segment connected at a first side of the base plate, a second plate segment, and a third plate segment substantially parallel to the base plate, the second plate segment being connected between the first and third plate segments; and a fixing plate defining a first end connected at a second side of the base plate and perpendicular to the base plate, and a second end having a snapping tongue bent and extended in a direction away from the connecting plate, a vertical distance between a free end of the snapping tongue and the base plate being equal to or smaller than that between the third plate segment and the base plate; and an indicating lamp holder detachably mounted on the annular plate.

9. The cooking range according to claim 8, wherein the fixing member is mounted on the heating unit by a bolt;

wherein the bracket has a snapping groove adapted to the snapping tongue, an upper surface of the third plate segment abutting against a lower surface of the bracket, and wherein the snapping tongue passes through the snapping groove so as to abut against an upper surface of the bracket, such that the fixing member clamps the bracket.

10. The cooking range according to claim 8, wherein the bracket comprises a first bracket and a second bracket parallel to each other and extended in a front-and-rear direction.

11. The cooking range according to claim 10, wherein a front mounting plate is connected with a front side wall of the aperture, is located below the annular platform, and has a first mounting portion, a second mounting portion and an inserting part between the first mounting portion and the second mounting portion, wherein the indicating lamp holder is disposed in the inserting part;

wherein a rear mounting plate is connected with a rear side wall of the aperture, is located below the annular bearing platform, and has a third mounting portion corresponding to the first mounting portion and a fourth mounting portion corresponding to the second mounting portion;

wherein first and second ends of the first bracket are detachably connected to the first mounting portion and the third mounting portion respectively; first and second ends of the second bracket are detachably connected to the second mounting portion and the fourth mounting portion respectively.

12. The cooking range according to claim 8, wherein the annular plate is integrally formed by a stamping process.

13. The cooking range according to claim 8, wherein an adhesive layer is disposed between the panel and the annular platform.

14. An oven, comprising a cooking range according to claim 8.

15. A fixing member, comprising:

a base plate defining a mounting hole;

a connecting plate comprising a first plate segment connected at a first side of the base plate, a second plate segment, and a third plate segment substantially parallel to the base plate, the second plate segment being connected between the first and third plate segments;

a fixing plate defining a first end connected at a second side of the base plate and perpendicular to the base plate, and a second end having a snapping tongue bent and extended in a direction away from the connecting plate, a vertical distance between a free end of the snapping tongue and the base plate being equal to or smaller than that between the third plate segment and the base plate;

wherein the fixing plate has a recess extended from an upper end of the fixing plate towards a lower end of the fixing plate, and an extension plate extended in a direction away from the base plate; and wherein the snapping tongue is disposed at a free end portion of the extension plate.

* * * * *